US009576763B2

(12) United States Patent
Houbre

(10) Patent No.: US 9,576,763 B2
(45) Date of Patent: Feb. 21, 2017

(54) REMOVABLE DEVICE FOR AN ELECTRONIC TRIP UNIT, POWER SUPPLY METHOD OF SUCH A DEVICE AND ASSEMBLY COMPRISING AN ELECTRONIC TRIP UNIT AND ONE SUCH REMOVABLE DEVICE

(71) Applicant: SCHNEIDER ELECTRIC INDUSTRIES SAS, Rueil-Malmaison (FR)

(72) Inventor: Pascal Houbre, Jarrie (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 419 days.

(21) Appl. No.: 14/304,118

(22) Filed: Jun. 13, 2014

(65) Prior Publication Data

US 2015/0002246 A1 Jan. 1, 2015

(30) Foreign Application Priority Data

Jun. 26, 2013 (FR) ..... 13 56134

(51) Int. Cl.
*H01H 83/04* (2006.01)
*H01H 83/20* (2006.01)
*H01H 71/12* (2006.01)

(52) U.S. Cl.
CPC ..... *H01H 71/123* (2013.01)

(58) Field of Classification Search
CPC ..... H01H 71/123; H01H 83/04; H01H 83/20; H01H 9/54

(Continued)

(56) References Cited

U.S. PATENT DOCUMENTS 5,877,691 A 3/1999 Suptitz et al.
5,933,306 A 8/1999 Santos et al.
(Continued)

FOREIGN PATENT DOCUMENTS

EP 0 843 332 A1 5/1998
EP 1 347 485 A1 9/2003
(Continued)

OTHER PUBLICATIONS

French Preliminary Search Report issued Apr. 29, 2014, in French Application No. 1356134 filed Jun. 26, 2013 (with Written Opinion and English Translation of Categories of Cited Documents).

*Primary Examiner* — Dharti Patel
(74) *Attorney, Agent, or Firm* — Oblon, McClelland, Maier & Neustadt, L.L.P.

(57) ABSTRACT

The removable device (20) according to the invention is designed to be connected to an electronic trip unit (10). The trip unit (10) comprises an internal electrical power supply bus (55) and the device (20) is adapted to be supplied with electrical energy via the internal electrical power supply bus (55). The device (20) comprises a withdrawal member (68) for withdrawing electrical energy on the internal electrical power supply bus (55). The trip unit (10) includes a switched-mode power supply (54) capable of delivering a power supply signal (S1). The withdrawal member (68) comprises detection means for detecting each rising edge of the power supply signal (S1), and the electrical energy of the power supply signal (S1) is withdrawn as of the detection of a rising edge.

11 Claims, 5 Drawing Sheets

(58) Field of Classification Search
USPC ..... 361/115
See application file for complete search history.

(56) References Cited

U.S. PATENT DOCUMENTS

| | | | | |
|---|---|---|---|---|
| 8,488,302 | B2 * | 7/2013 | Mills | H02B 1/04 361/622 |
| 2003/0178292 | A1 | 9/2003 | Gerard et al. | |
| 2005/0253573 | A1 | 11/2005 | Budillon et al. | |

FOREIGN PATENT DOCUMENTS

| | | | |
|---|---|---|---|
| EP | 1 596 206 | A1 | 11/2005 |
| WO | WO 99/36928 | | 7/1999 |
| WO | WO 2012/007831 | A2 | 1/2012 |

* cited by examiner

REMOVABLE DEVICE FOR AN ELECTRONIC TRIP UNIT, POWER SUPPLY METHOD OF SUCH A DEVICE AND ASSEMBLY COMPRISING AN ELECTRONIC TRIP UNIT AND ONE SUCH REMOVABLE DEVICE

The present invention relates to a removable device that can be connected to an electronic trip unit, a power supply method of such a removable device connected to the trip unit, and an assembly comprising the electronic trip unit and the removable device.

In the field of electrical installations, it is known to use current and energy measuring means in order to monitor the electrical installations and to be able to propose optimization solutions for those installations.

However, many existing electrical installations do not comprise current and energy measuring means. One recurring stake is therefore the implementation, in existing electrical installations, of means for measuring current and energy and transmitting that information.

It is known from document FR-A-2,756,095 to fasten a communication module on an electronic trip unit of a circuit breaker unit, in order to use the sensors and the acquisition chain of the circuit breaker unit to perform the current and energy measurements and communicate that information. The communication module is fastened to the back of the electronic trip unit. This fastening operation requires disassembling the trip unit in order to place the communication module. It is therefore complex to perform and requires cabling operations for cabling the communication module to the trip unit, since the communication module must be connected to a bus of the circuit breaker in order to be supplied with electrical energy.

Is also known to use a communication module powered by a battery or an independent power supply source outside the trip unit or the circuit breaker. In the case of a battery, this requires that the battery always be charged and in working order, which is not guaranteed, and in the case of an outside power supply, cabling must be done between the communication module and the external power supply, which is generally complex due to a lack of available space or access difficulties.

The aim of the invention is therefore to propose a removable device that is easy to connect to a trip unit and inexpensive.

To that end, the invention relates to a removable device designed to be connected to an electronic trip unit, said trip unit including a housing, a connector received in an orifice formed in a wall of the housing, the connector being accessible from outside the housing, and an internal power supply bus positioned inside the housing, the removable device being adapted to be connected to said connector and to be supplied with electrical energy via the internal power supply bus when it is connected to the connector. According to the invention, the removable device comprises a withdrawal member for withdrawing electrical energy from the internal power supply bus, while the trip unit includes a switched-mode power supply capable of delivering a power supply signal, and while the withdrawal member comprises detection means for detecting each rising edge of the power supply signal, the electrical energy of the power supply signal being withdrawn as of the detection of a rising edge.

According to advantageous aspects of the invention, the removable device further comprises one or more of the following features, considered alone or according to all technically acceptable combinations:

- the removable device further includes a processing unit, a radio communication module, and transmitting means for transmitting withdrawn electrical energy to at least one electrical member from among the processing unit and the radio communication module.
- the withdrawal member comprises a generator generating a first reference voltage and comparison means for comparing a trip signal, depending on the power supply signal, with the first reference voltage, while the withdrawal member is capable of withdrawing electrical energy from the power supply signal, from the detection of the rising edge and as long as the trip signal has a voltage above the first reference voltage, each rising edge being detected using a detection means and the signal being compared with the first reference voltage using comparison means;
- the withdrawal member is capable of withdrawing the electrical energy from the power supply signal only once the power supply signal has reached a second predetermined reference voltage;
- the trip unit comprises a first processing unit capable of recovering measurement and/or status information for an electrical installation to which the circuit breaker is connected, while the removable device comprises a second processing unit capable of receiving said information, and the removable device is capable of displaying and/or transmitting said information;
- the removable device comprises a radio communication module including a first wireless transceiver, the radio communication module being capable of transmitting said information to a supervision apparatus including a second wireless transceiver.

The invention also relates to a power supply method of a removable device connected to an electronic trip unit, said trip unit including a housing, a connector received in an orifice formed in a wall of the housing, the connector being accessible from the outside of the housing, and an internal power supply bus positioned inside the housing, the removable device being connected to said connector and supplied with electrical energy via the internal power supply bus. According to the invention, the method comprises the following steps:

a) detecting a rising edge of a power supply signal, the trip unit including a switched-mode power supply capable of delivering the power supply signal, b) withdrawing the electrical energy from the power supply signal once the rising edge is detected.

According to other advantageous aspects of the invention, the power supply method of a removable device further comprises one or more of the following features, considered alone or according to all technically acceptable combinations:

- after the detection step and before the withdrawal step, the method comprises a step for comparing a trip signal, depending on the power supply signal, with a first reference voltage, whereas, during the withdrawal step, the electrical energy from the power supply signal is withdrawn as of detection of the rising edge and as long as the voltage of the trip signal is above the first reference voltage;
- the withdrawal step is carried out only once the power supply signal has reached a second predetermined reference voltage.

The invention also relates to an assembly comprising an electronic trip unit intended to be installed in an electrical panel and a removable device designed to be connected to the electronic trip unit, the trip unit including a housing, a connector received in an orifice formed in a wall of the housing, the connector being accessible from outside the housing, and an internal power supply bus positioned inside the housing. The removable device is as mentioned above.

According to another advantageous aspect of the invention, the connector is accessible from outside the electrical panel when the trip unit is installed in the electrical panel.

Owing to the invention, the removable device is directly powered by the trip unit and therefore does not comprise a battery or external power supply source, which facilitates the installation of such a device in an electronic panel. Additionally, the removable device can easily be connected to the trip unit or disconnected from the trip unit using the connector accessible from outside the housing of the trip unit.

The invention will be better understood, and other advantages thereof will appear more clearly, in light of the following description, provided solely as a non-limiting example, and done in reference to the appended drawings, in which.

Figure 1:
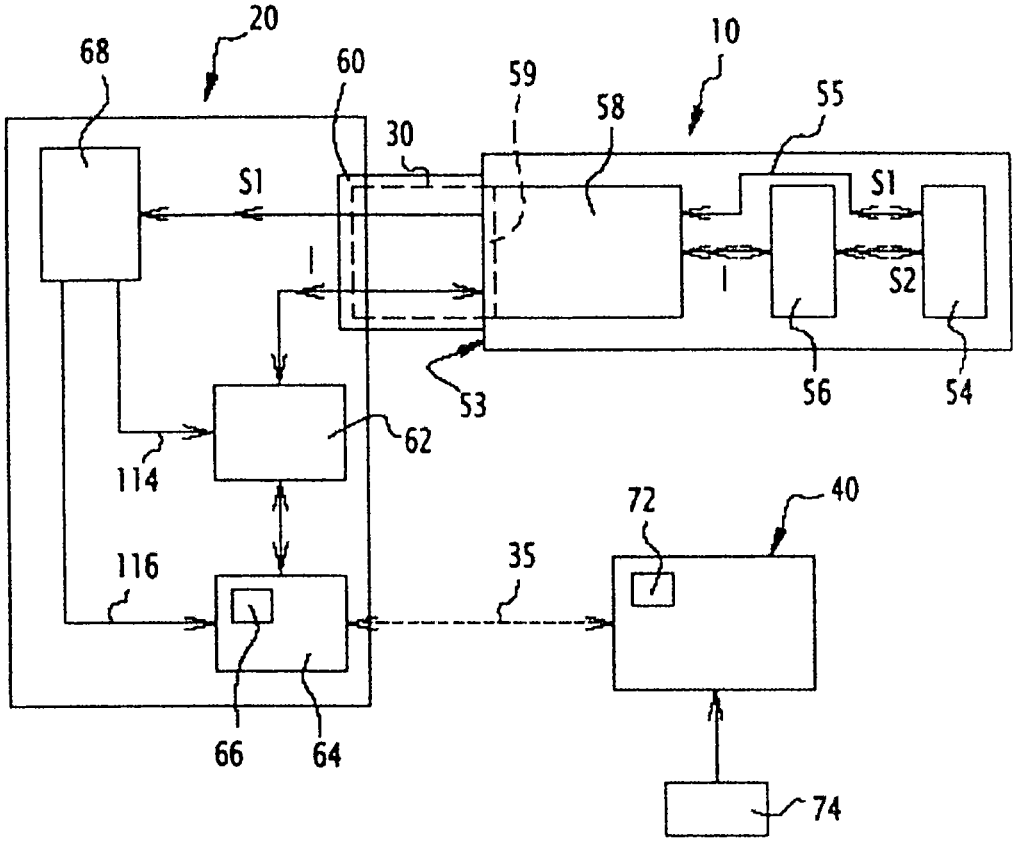
FIG. 1 is a diagrammatic illustration of an electronic trip unit to which a removable device according to the invention is connected.

In FIG. 1, an electronic trip unit 10 of a circuit breaker is connected to a removable device 20 using a communication bus 30. The removable device 20 is also connected, by a wireless link 35, to a supervision apparatus 40.

The electronic trip unit 10 comprises a protective housing 52 including several walls 53. The trip unit 10 comprises an electrical power supply 54, an internal electrical power supply bus 55 and a first processing unit 56, such as a microprocessor, arranged inside the protective housing 52. The trip unit 10 comprises an electrical connector 58 for connecting the removable device 20, the connector 58 being received in an orifice 59 formed in one of the walls 53, preferably in a wall 53 accessible from the outside when the trip unit 10 is installed in an electrical panel.

The removable device 20 is for example a communication module and comprises a connector 60 complementary to the connector 58, a second processing unit 62, a radio communication module 64 including a wireless transceiver 66, and a withdrawal member 68 for withdrawing electrical energy on the internal power supply bus 55. The removable device 20 can be connected/disconnected hot from the electronic trip unit 10 (plug and play), without any risk of malfunction of the trip unit 10.

The supervision apparatus 40, also called a concentrator, is capable of communicating with the removable device 20 in order to centralize information received from the various trip units 10 and supervise each of the trip units 10. The supervision apparatus 40 includes a wireless transceiver 72 and is intended to be powered by an external electrical power supply 74.

Additionally, the supervision apparatus 40 is capable, by means of its wireless transceiver 72, of transmitting a message commanding the sending of information or a message of time synchronization, to the removable device 20, and more specifically to the radio communication module 64, which is capable of transmitting a message to the second processing unit 62.

Figure 3:
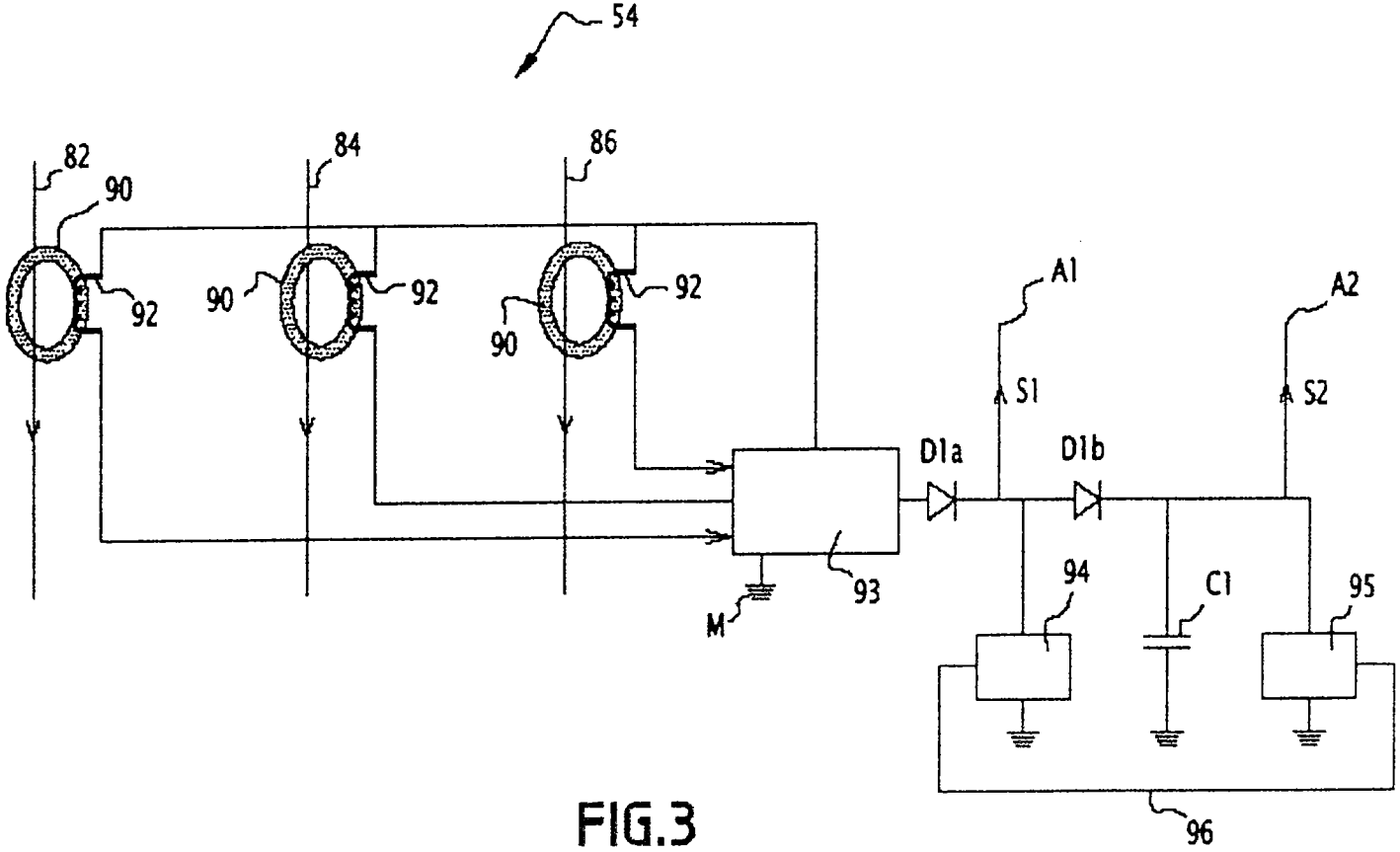
FIG. 3 is an illustration of an electrical power supply of the electronic trip unit of FIGS. 1 and 2.

The electrical power supply 54 is more precisely shown in FIG. 3, in the case where the circuit breaker 10 is connected on a three-phase network comprising three phase wires 82, 84 and 86. The electrical power supply 54 includes, for each of the phase wires 82, 84, 86, a toroid 90 positioned around the corresponding phase wires 82, 84, 86 and a winding 92 arranged around each toroid 90. The circulation of the current in the corresponding phase wires 82, 84 and 86 is capable of creating an induced current in each winding 92. In other words, the trip unit 10 is self-powered by the toroids 90 and the windings 92, which recover the magnetic energy from the three-phase network and form current transformers. Each toroid 90 is an iron toroid.

The electrical power supply 54 also includes a converter 93, such as a rectifier of the Graetz bridge type, connected to each of the windings 92, as well as an electrical ground M, the converter 93 being capable of delivering a positive voltage.

The electrical power supply 54 comprises a diode D1*b*, a chopper 94, a capacitor C1 for supplying power to the trip unit and a commanding member 95 for commanding the chopper 94.

A1 denotes an output of the converter 93 that is connected to the chopper 94, which in turn is connected to the ground M. The chopper 94 is also connected to a terminal of the power supply capacitor C1 by means of the diode D1*b*, the other terminal of the capacitor C1 being connected to the ground M. A2 denotes output of the diode D1*b* connected to the terminal of the capacitor C1. The control unit 95 of the chopper 94 is connected in parallel with the power supply capacitor C1, the chopper 94 and the control unit 95 being connected by means of an electrical link 96. There are a first power supply signal S1 at the output A1 and a second signal S2 at the output A2.

Figure 2:
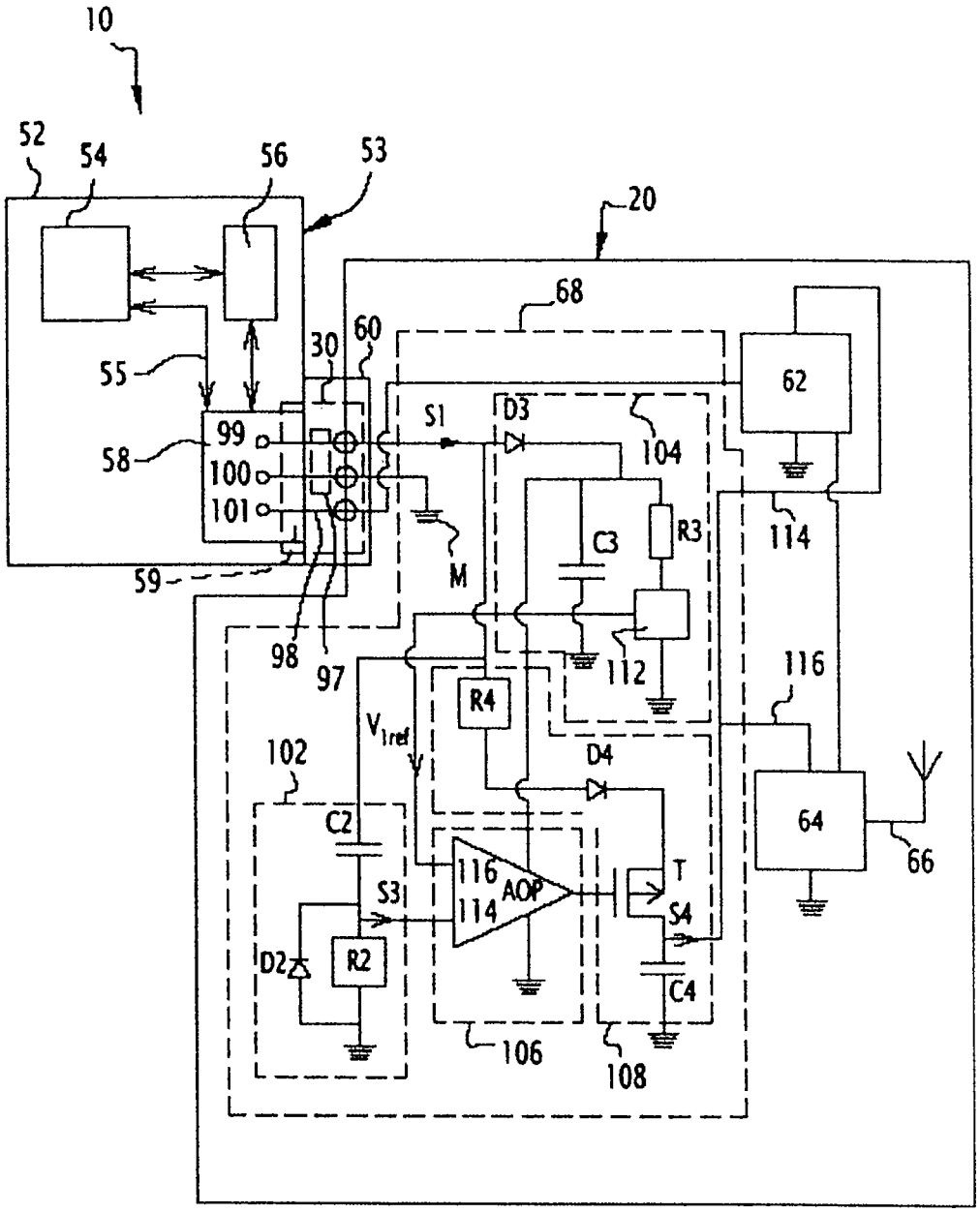
FIG. 2 is a detailed illustration of the trip unit and the removable device of FIG. 1.

The internal electrical power supply bus 55, shown in FIG. 2, is positioned between the electrical power supply 54 and the connector 58, and is capable of transmitting the power supply signal S1 to the connector 58.

The first processing unit 56 is capable of recovering the information relative to the current circulating in each phase wire 82, 84, 86, the current being measured by means of current sensors positioned around each phase wire 82, 84, 86. The toroids 90 associated with the windings 92 are capable, in certain cases, of acting as current sensors. Furthermore, the first processing unit 56 is also capable of calculating the electrical powers and energies from the received and measured current values. "I" denotes the information relative to the current, energy and power values measured or calculated by the first processing unit 56.

The connector 58 is accessible from outside the housing 53, preferably from a front face of the electrical panel when the trip unit 10 is installed in said panel. As shown in FIG. 2, the connector 58 comprises three output terminals, respectively denoted 99, 100 and 101. The first output terminal 99 corresponds to the first power supply signal S1. The second output terminal 100 corresponds to the ground M, and the third output terminal 101 corresponds to the information I. The first output terminal 99 and the second output terminal 100 are directly connected to the electrical energy withdrawal member 68, via the communication bus 30 and the connector 60. The third output terminal 101 is directly connected to the second processing unit 62, via the communication bus 30 and the connector 60.

The connector 60 is a connector complementary to the connector 58. The connector 58 is, for example, a female plug, and the connector 60 is then a male plug.

The second processing unit 62 is capable of recovering the information I, via the connection between the connectors 58 and 60, and is capable of sending that information to the radio communication module 64.

The radio communication module 64 is capable, by means of its wireless transceiver 66, of sending the information I to the supervision apparatus 40 via the wireless link 35 arranged between the transceiver 66 and the transceiver 72.

The wireless transmitter 66 is preferably according to the ZIGBEE or ZIGBEE green power communication protocol based on standard IEEE-802.15.4. Alternatively, the wireless transmitter 66 is in accordance with standard IEEE-802.15.1 or standard IEEE-802.15.2. Also alternatively, the wireless transceiver 66 is preferably according to standard IEEE-802-11. Also alternatively, without meeting an IEEE standard, this transceiver 66 complies with the regulations in force in each country.

The electrical energy withdrawal member 68 is shown in FIG. 2 in more detail than in FIG. 1, and according to one embodiment of the invention. The electrical energy withdrawal member 68 comprises detection means 102 and a generator 104 generating a first reference voltage $V_{1ref}$. The withdrawal member 68 further includes voltage comparison means 106. The withdrawal member 68 also comprises withdrawal means 108 for withdrawing electrical energy on the power supply bus 55.

The wireless transceiver 72 is similar to the wireless transceiver 66, such that the wireless radio communication 35 is established between the removable device 20 and the supervision apparatus 40, and more particularly between the wireless module 64 and the supervision apparatus 40.

The detection means 102 comprise a diode D2 connected in parallel with a resistance R2, and a capacitor C2 connected in series with the resistance R2. The detection means 102 correspond to a bypass circuit formed by the capacitor C2 and the resistance R2, and are directly connected to the first output terminal 99 corresponding to the first signal S1. The detection means 102 are capable of detecting each rising edge of the power supply signal S1, the signal S1 being delivered by the power supply bus 55 via the connection between the connectors 58 and 60. The shared terminal between the diode D2, the capacitor C2 and the resistance R2 is capable of delivering a third signal S3.

The generator 104 of the first reference voltage $V_{1ref}$ comprises a capacitor C3, a resistance R3, a diode D3 and a component 112 that generates the first reference voltage $V_{1ref}$.

The comparison means 106 are for example formed by an operational amplifier AOP whereof a first non-inverting input 114 is connected to the shared terminal between the diode D2, the capacitor C2 and the resistance R2. The amplifier AOP also comprises an inverting input 116 on which the first reference voltage $V_{1ref}$ is delivered, the inverting input 116 being connected to the generator 104. The operational amplifier AOP is powered from the capacitor C3. The comparison means 106 are capable of comparing the third signal S3 with the first reference voltage $V_{1ref}$.

The withdrawal means 108 are directly connected to the first output 99 and comprise a resistance R4 and a diode D4 connected in series to the source of the transistor T, as well as a capacitor C4 connected to the drain of the transistor T. Additionally, the grid of the transistor T is connected at the output 117 of the amplifier AOP. The withdrawal means 108 are capable of withdrawing the electrical energy delivered by the internal electrical power supply bus 55.

Links 114 and 116 of the withdrawal means 108 with the second processing unit 62 and the radio communication unit 64, respectively, form transmitting means for transmitting electrical energy withdrawn by the withdrawal means 108.

The second signal S2, at the output A2 of the electrical power supply 54, is capable of powering the trip unit 10, while the first signal S1, at the output A1, is capable of being delivered to the removable device 20 and the withdrawal member 68 by means of the power supply bus 55, the communication bus 30 and the connectors 58 and 60. The first signal S1 makes it possible to supply power to the removable device 20.

It is important to note that the electrical power supply 54 is a switched-mode power supply. More specifically, when the contacts of the circuit breaker comprising the trip unit 10 are closed, the voltage of each signal S1, S2 increases because the power supply capacitor C1 of the trip unit 10 is being charged. Then, once the voltage across the terminals of the capacitor C1 exceeds a second predetermined reference voltage $V_{2ref}$, the chopping of the power supply 54 and the first power supply signal S1, by the chopper 94, is tripped by the control unit 95. Thus, once the first signal S1 and the second signal S2 have reached the second reference voltage $V_{2ref}$ with a predetermined value, the control unit 95 trips the chopper 94. In fact, the unit 95 commands the chopper 94, which is for example equivalent to a CMOS transistor, in the on or off state.

Figure 4:
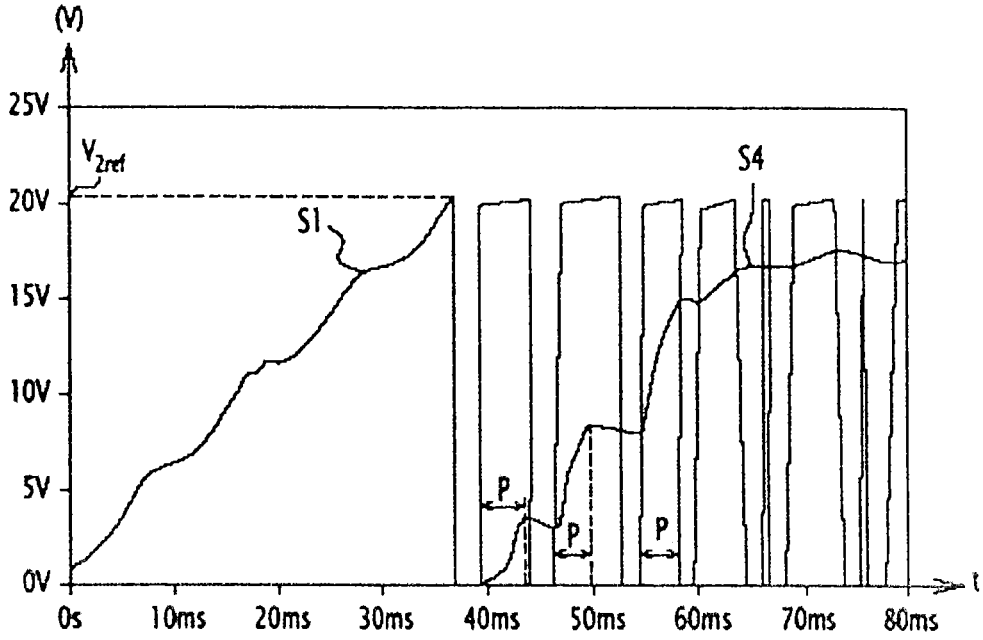
FIG. 4 is a set of two curves showing the voltage output of the electrical power supply of FIG. 3, as a function of time, on the one hand, and the voltage withdrawn by the removable device of FIGS. 1 to 2 from the electrical power supply of FIG. 3, as a function of time, on the other hand.

Once the chopper 94 is tripped, the control unit 95 commands the chopper 94 according to the value of the voltage of the second signal S2 at the output A2, i.e., across the terminals of the capacitor C1. FIG. 4 shows a series of low states and high states for the first signal Si. When the voltage of the second signal S2 is greater than the second reference voltage $V_{2ref}$, the chopper 94 is commanded in order to short-circuit the electrical power supply 54, i.e., to set the voltage of the first signal S1 at a zero value, which corresponds to a low state. Then, when the value of the voltage of the second signal S2 once again passes below a third reference voltage, the chopper 94 is commanded so as to no longer short-circuit the electrical power supply 54. In other words, in order for the power supply 54 to charge the capacitor C1 and the first signal S1 to have a voltage value globally equivalent to the voltage of the second signal S2. This corresponds to a high state of the first signal S1.

Thus, during chopping of the electrical power supply 54, the power supply capacitor C1 of the trip unit 10 becomes charged when the voltage of the second signal S2 exceeds the second reference voltage $V_{2ref}$, then is discharged when the signal S1 is in the low state and the trip unit 10, more specifically the first processing unit 56, is consuming current. The second signal S2 successively corresponds to a charge, then a discharge of the capacitor C1, while the first signal S1 is successively in the high state, then the low state. The signal S1 therefore includes successive voltage pulses.

FIG. 4 shows the chopping of the signal Si with a series of rising edges and falling edges, which take place once the first signal Si has reached the second reference voltage $V_{2ref}$. This second reference voltage $V_{2ref}$ globally corresponds to the desired voltage across the terminals of the capacitor C1, so that the capacitor C1 has stored enough electrical energy to power the trip unit 10, during the periods where the chopper 94 short-circuits the electrical power supply 54.

Once the first signal S1 has reached second reference voltage $V_{2ref}$, the electrical energy stored by the capacitor C1 is sufficient, and it is therefore no longer necessary to charge the capacitor C1 and the electrical power supply 54 can be short-circuited. Then, after a certain amount of time that is globally constant, because the consumption of the trip unit 10 is globally constant, the short-circuit is reopened in order to recharge the capacitor C1 for supplying power to the trip unit 10.

Figure 5:
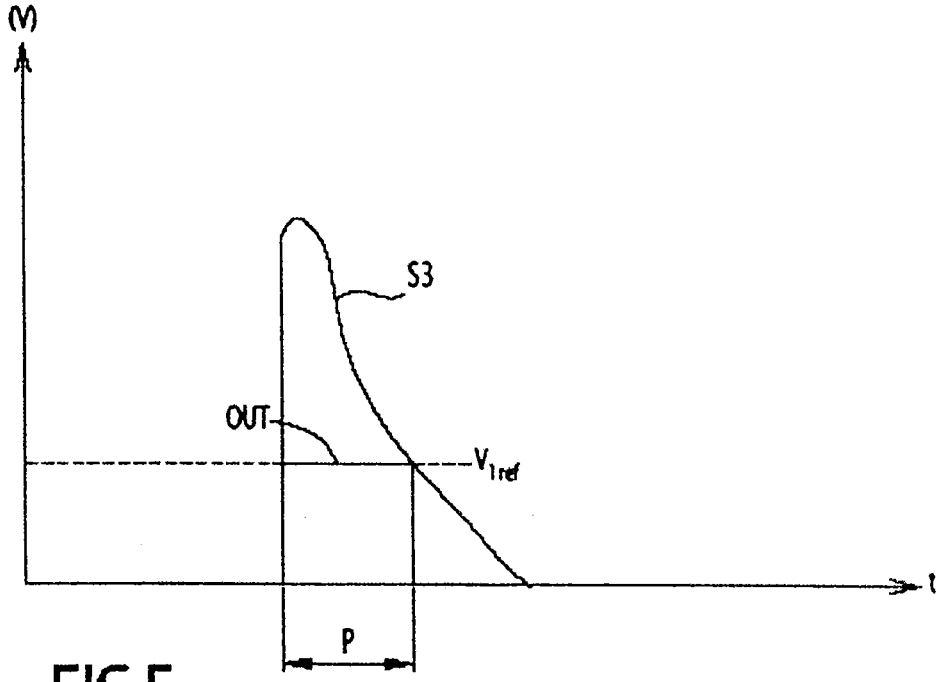
FIG. 5 is a curve showing the output voltage of detection means belonging to the removable device as a function of time and when the voltage at said output of the electrical power supply of FIG. 3 is in the high state.

Once the chopping of the electrical power supply 54 is tripped, the detection means 102 are then capable of detecting rising edges of the power supply signal S1 delivered by the electrical power supply bus 55. When a rising edge of the first signal S1 is detected, the capacitor C2 will charge itself and send, on the input 114 of the amplifier AOP, the third signal S3 globally corresponding to the drift of the signal S1. At that moment, the third signal S3 therefore has a high voltage value. Then, as shown in FIG. 5, during the charge of C2 through the resistance R2, when the first signal S1 is in the high state, the voltage of the third signal S3 decreases exponentially, with a time constant equal to the product of the value of the resistance R2 and the capacity of the capacitor C2. Then, when the first signal S1 enters the low state, the capacitor C2 discharges through the diode D2.

The operational amplifier AOP has, on the non-inverting input 114, the third signal S3, and on the inverting input 116, the first reference voltage $V_{1ref}$. Thus, when a rising edge of the power supply signal S1 appears with a significant slope, i.e., a significant drift, the voltage of the third signal S3 is greater than the first reference voltage $V_{1ref}$, as shown in FIG. 5, and the output 117 of the operational amplifier AOP is in the high state. Likewise, when the power supply signal S1 stabilizes, i.e., the charging of the power supply capacitor C1 of the trip unit 10 is complete, the voltage of the third signal S3 is below the first reference voltage $V_{1ref}$ and the output 117 of the amplifier AOP enters the low state. The change in the state of the output 117 as a function of the state of the first signal S1 and the time is shown in FIG. 5 by a curve OUT.

The change of the output 117 of the amplifier AOP makes it possible to turn the transistor T successively on, then off. In fact, the output of the amplifier AOP is successively in the high state, in which case the transistor T is on, then in the low state, in which case the transistor T is off. When the transistor T is on, the capacitor C4 withdraws energy on the power supply signal S1 and charges, whereas when the transistor T is off, the capacitor C4 gradually discharges. The transistor T used in this embodiment is, for example, a MOS transistor.

Thus, the withdrawal member 68 is capable of withdrawing electrical energy from the power supply signal S1, from the detection of a rising edge, and as long as the third signal S3 has a voltage above the first reference voltage $C_{1ref}$. The third signal S3 is equivalent to a trip signal of the withdrawal of electrical energy from the signal S1 by the withdrawal means 108. In fact, the third signal S3 makes it possible to command the output 117 of the amplifier AOP, and therefore the state of the transistor T.

In FIG. 4, a fourth signal S4 representing the voltage across the terminals of the capacitor C4 is shown, as a function of time. The capacitor C4 charges, when the power supply signal S1 is in the high state and the output 117 of the AOP is in the high state. In other words, it withdraws electrical energy on the internal electrical power supply bus 55 and the first signal S1. Likewise, the capacitor C4 discharges when the power supply signal S1 is in the low state or the output 117 of the AOP is in the low state. In other words, it does not withdraw electrical energy on the internal electrical power supply bus 55 and it gradually discharges in order to power the second processing unit 62 and the radio communication module 64, owing to the signal S4.

FIG. 4 also shows that the periods P during which the capacitor C4 charges, i.e., during which the withdrawal means 108 withdraw energy on the signal S1, do not necessarily have a constant length. The time during which electrical energy is withdrawn on the power supply signal S1 is always shorter than the time during which the signal S1 is in the high state. In fact, as shown in FIG. 5, when the first signal S1 enters the high state, the voltage of the third signal S3 increases greatly, then subsequently decreases exponentially. The output 117 that corresponds to the curve OUT is then in the high state, and the transistor T is on, which makes it possible to charge the capacitor C4. The moment where the first signal S1 enters the high state corresponds to the beginning of the period P. Then, when the voltage of the third signal S3 becomes lower than the first reference voltage $V_{1ref}$, the output 117 enters the low state, the transistor T becomes off, and the capacitor C4 then discharges. This moment corresponds to the end of the period P. The length of each period P, and therefore of withdrawal by the capacitor C4 of electrical energy delivered by the first signal S1, depends on the moment where the third signal S3 has a voltage below the first reference voltage $V_{1ref}$. The widths of the pulses of the signal S1 are variable, since the power supply current of the capacitor C1 is sinusoidal. Thus, upon each rising edge of the signal S1, the value of the current making it possible to charge the capacitor C1 is not always the same. This implies that the charge of the capacitor C1 is longer or shorter and that the power supply signal S1 is in the high state for a longer or shorter length of time.

It is important to note that when the power contacts of the circuit breaker comprising the trip unit 10 are closed, the charging of the capacitor C1 is done progressively, i.e., the drift of the power supply signal S1 at that moment is low. This implies that the signal S3 is low compared with the first reference voltage $V_{1ref}$, and that the output 117 of the operational amplifier AOP is in the low state.

The embodiment of the withdrawal member 68 shown above corresponds to an analog situation. Alternatively, the energy is withdrawn digitally using a microcontroller.

Figure 6:
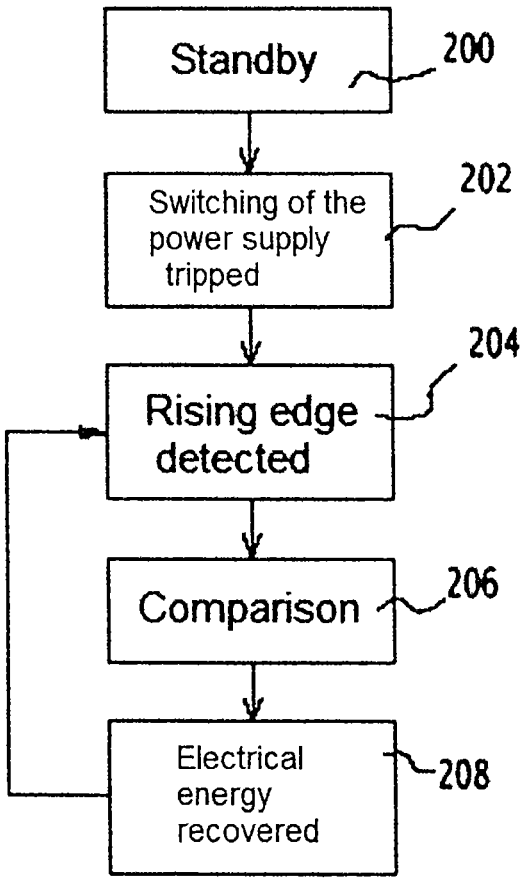
FIG. 6 is a flowchart of the steps of a method according to the invention.

A power supply method for powering the removable device 20 from the electrical power supply 54, shown in FIG. 6, comprises a first step 200 during which, when the circuit breaker is closed, one waits for the first signal S1 to reach the second reference voltage $V_{2ref}$ at least once.

Then, a second step 202 consists of tripping the chopping of the electrical power supply 54, and therefore of the signal S1, once the first signal S1 has reached the second reference voltage $V_{2ref}$.

Next, once the chopping is tripped, a third step 204 consists of detecting a rising edge of the power supply signal S1 using the detection means 102.

This third step 204 is followed by a fourth step 206 comparing the third signal S3, also called trip signal, with the first reference voltage $V_{1ref}$. This fourth step 206 is carried out using comparison means 106.

Lastly, during a fifth withdrawal step 208, the withdrawal means 108 withdraw electrical energy on the power supply bus 55 and on the power supply signal S1 as long as the third signal S3 has a value above that of the first reference voltage $V_{1ref}$. Following the withdrawal step 208, one returns to the detection step 204 as long as the circuit breaker 10 remains closed.

It is important to note that when the circuit breaker 10 is open, the signal S1 is zero and no electrical energy is withdrawn by the withdrawal member 68. The first step 200 generally takes place upon closing of the circuit breaker 10 once the power supply capacitor C1 is charged and the power supply signal S1 has reached the second reference voltage $V_{2ref}$.

The invention thus makes it possible to withdraw electrical energy, on the internal power supply bus 55 of the electronic trip unit 10, without disrupting the measurement of the current or the operation of the trip unit 10, and more particularly of its processing unit 56. In fact, when the current on the phase wires 82, 84, 86 is too low, the trip unit 10 is powered as a priority and the removable device 20 does not work. The withdrawal means 108 withdraw electrical energy on the signal S2 only when the capacitor C1 for supplying power to the trip unit 10 is charged and the first processing unit 56 is operating. It is in fact at that time that the chopping, or dividing, of the electrical power supply 54 is tripped, since the capacitor C1 for supplying power to the trip unit 10 has stored enough energy to power the trip unit 10, and it is therefore no longer necessary to charge the capacitor C1 continuously.

The removable module 20 withdraws electrical energy on the power supply signal S1 globally upon each pulse of the signal S1. This makes it possible to charge its capacitor C4, which is powering the second processing unit 62 in the radio application module 64. After several chopping sequences, i.e., after several pulses of the signal S1, the capacitor C4 is charged and the voltage of the signal S4 is equal to or slightly below the voltage of the signal S1, when it is in the high state.

The removable device 20 withdraws energy on the electrical power supply 54 only when a rising edge appears, i.e., upon a pulse that appears once the chopper 94 is operating and chops the signal S1, and during charging of the capacitor C1. The operation of the trip unit 10 is therefore not disrupted by the withdrawal of electrical energy by the withdrawal member 68.

In a complementary manner, the voltage dividers are added to the withdrawal member 68 to limit the voltage values of the signal S4 to values compatible with the power supply of the second processing unit 62 and the radio communication module 64. Additionally, the signal S4 sent by the capacitor C4 to the second processing unit 62 and to the radio application module 64 is, in a complementary manner, chopped to have a mean continuous voltage with a suitable value.

The invention described above allows progressive charging of the capacitor C4 and the communication is established periodically, i.e., for example every second, between the radio communication module 64 and the supervision apparatus 40 in order to exchange the current, power, energy or other information I regarding an electrical installation equipped with the circuit breaker 10. Thus, in this example, the radio communication module 64 and the processing unit 62 consume electrical energy stored in the capacitor C4, every second. Between these consumption periods, the capacitor C4 is charged from the power supply signal S1, as described above, and the processing unit 62 and the radio communication module 64 do not consume much.

The trip unit 10 further makes it possible to measure the currents and the opening of the contacts of the circuit breaker, if an overvoltage is detected.

Lastly, it should be noted that the capacitor C4 has a high capacity, for example six microfarads (μF), in order to store a significant quantity of electrical energy. Furthermore, the number of pulses, i.e., of chopping sequences, necessary to charge the capacitor C4 depends on the first signal S1, the values of the resistance R2, the capacity of the capacitor C2 and the first reference voltage value $V_{1ref}$.

According to one alternative, the electronic trip unit 10 is not powered from toroids 90 and windings 92, but by a secondary power supply.

According to another alternative, the removable device does not allow radio communication as described above, but a wired communication or simply a display of information on a screen.

According to another alternative, the time during which the capacitor C4 is charged is constant and set at a value equal to the shortest possible time for a pulse of the signal S1.

The invention claimed is:

1. A removable device designed to be connected to an electronic trip unit , the trip unit including a housing, a connector received in an orifice formed in a wall of the housing, the connector being accessible from outside the housing, and an internal power supply bus positioned inside the housing, the removable device being adapted to be connected to said connector and to be supplied with electrical energy via the internal electrical power supply bus, when it is connected to the connector, wherein the removable device comprises a withdrawal member for withdrawing electrical energy from the internal power supply bus, wherein the trip unit includes a switched-mode power supply capable of delivering a power supply signal, and wherein the withdrawal member comprises detection means for detecting each rising edge of the power supply signal, the electrical energy of the power supply signal being withdrawn as of the detection of a rising edge.

2. The removable device according to claim 1, wherein the removable device further includes a processing unit, a radio communication module, and transmitting means for transmitting withdrawn electrical energy to at least one electrical member from among the processing unit and the radio communication module.

3. The removable device according to claim 1, wherein the withdrawal member comprises a generator generating a first reference voltage and comparison means for comparing a trip signal, depending on the power supply signal, with the first reference voltage, and wherein the withdrawal member is capable of withdrawing electrical energy from the power supply signal, from the detection of the rising edge and as long as the trip signal has a voltage above the first reference voltage, each rising edge being detected using the detection means and the signal being compared with the first reference voltage using the comparison means.

4. The removable device according to claim 3, wherein the withdrawal member is capable of withdrawing the electrical energy from the power supply signal only once the power supply signal has reached a second predetermined reference voltage.

5. The removable device according to claim 1, wherein the trip unit comprises a first processing unit capable of recovering measurement and/or status information for an electrical installation to which the circuit breaker is connected, wherein the removable device comprises a second processing unit capable of receiving said information, and wherein the removable device is capable of displaying and/or transmitting said information.

6. The removable device according to claim 5, wherein it comprises a radio communication module including a first wireless transceiver, the radio communication module being capable of transmitting said information to a supervision apparatus including a second wireless transceiver.

7. A method for powering a removable device connected to an electronic trip unit, the trip unit including a housing, a connector received in an orifice formed in a wall of the housing, the connector being accessible from outside the housing, and an internal electrical power supply bus positioned inside the housing, the removable device being connected to the connector and supplied with electrical energy via the internal electrical power supply bus, wherein the method comprises the following steps:

a) detecting a rising edge of a power supply signal, the trip unit including a switched-mode power supply capable of delivering the power supply signal, b) withdrawing the electrical energy from the power supply signal once the rising edge is detected.

8. The method according to claim 7, wherein after the detection step and before the withdrawal step, the method comprises a comparing step for comparing a trip signal, depending on the power supply signal, with a first reference voltage, and wherein during the withdrawal step, the electrical energy from the power supply signal is withdrawn from the detection of the rising edge and as long as the voltage of the trip signal is above the first reference voltage.

9. The method according to claim 8, wherein the withdrawal step is done only once the power supply signal has reached a second predetermined reference voltage.

10. An assembly comprising an electronic trip unit designed to be installed in an electrical panel and a removable device designed to be connected to the electronic trip unit, the trip unit including a housing, a connector received in an orifice formed in a wall of the housing, the connector being accessible from outside the housing, and an internal power supply bus positioned inside the housing, wherein the removable device is according to claim 1.

11. The assembly according to claim 10, wherein the connector is accessible from outside the electrical panel when the trip unit is installed in the electrical panel.

* * * * *